FIP7811 OR 4,008,922

United States Patent [19]

Kallin et al.

[11] 4,008,922

[45] Feb. 22, 1977

[54] METHOD AND A MACHINE FOR ADVANCING AN UNDERGROUND FACE OF A GEOLOGICAL FORMATION

[75] Inventors: Karl Åke Kallin, Bandhagen; Jan August Larcén, Ektorp; Waldemar Meyer, Stockholm, all of Sweden

[73] Assignee: Atlas Copco Aktiebolag, Nacka, Sweden

[22] Filed: Dec. 5, 1974

[21] Appl. No.: 529,968

[30] Foreign Application Priority Data

Dec. 7, 1973 Sweden ..... 7316553

[52] U.S. Cl. ..... 299/13; 173/52; 299/19

[51] Int. Cl.[2] ..... E21D 9/00

[58] Field of Search ..... 173/52; 299/13, 19, 299/12; 102/22, 23

[56] References Cited

UNITED STATES PATENTS

| | | | |
|---|---|---|---|
| 867,284 | 10/1907 | Maxwell | 173/52 |
| 922,431 | 5/1909 | Japp | 173/52 X |
| 1,789,735 | 1/1931 | Fisher | 299/13 X |
| 1,833,368 | 11/1931 | O'Rourke | 299/13 |
| 1,833,369 | 11/1931 | O'Rourke | 299/13 |
| 2,026,627 | 1/1936 | Gilman | 173/52 X |
| 3,473,616 | 10/1969 | Johansson | 173/52 X |
| 3.623,771 | 11/1971 | Sonsnowicz | 299/13 X |
| 3,721,471 | 3/1973 | Bergmann et al. | 299/13 X |
| 3,727,867 | 4/1973 | Toppila | 173/43 X |

*Primary Examiner*—Ernest R. Purser
*Assistant Examiner*—William F. Pate, III
*Attorney, Agent, or Firm*—Flynn & Frishauf

[57] ABSTRACT

A method for driving tunnels in rounds is disclosed in which, after each round, the tunnel is left with an inclined transition to the floor. In the subsequent round, a cut is opened up in the transition towards the floor and the tunnel face is then stepwise drilled and blasted in cycles until the roof is reached and the round is completed. A machine for carrying out the method is disclosed which comprises a plurality of drill-and-blast units that are mounted on a frame that is pivotable about a transverse horizontal axis.

52 Claims, 7 Drawing Figures

Fig. 4
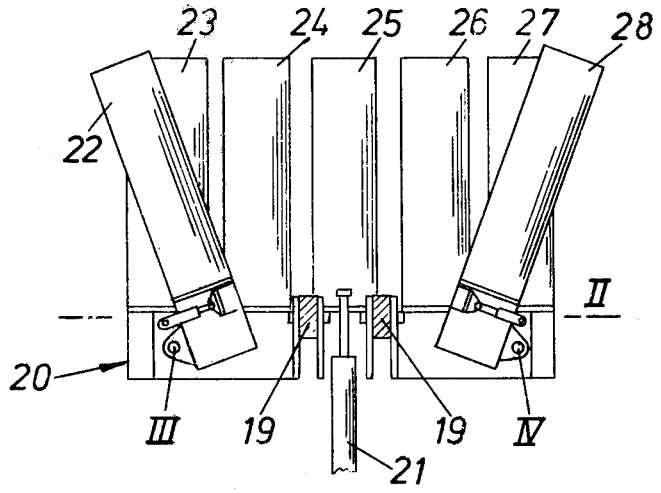
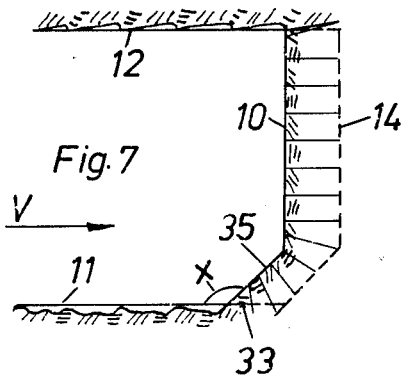
Fig. 7
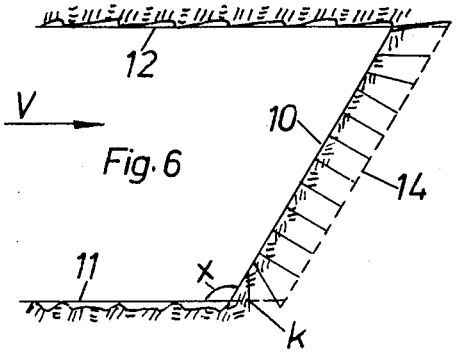
Fig. 6
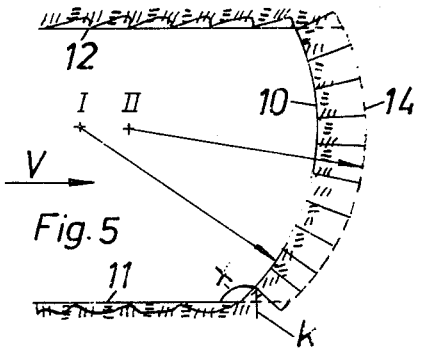
Fig. 5

METHOD AND A MACHINE FOR ADVANCING AN UNDERGROUND FACE OF A GEOLOGICAL FORMATION

The present invention relates to a method for advancing an underground face of a geological formation in rounds comprising a plurality of cycles, that in turn comprises the drilling of a plurality of holes in the face and the applying of break-down-energy to the holes so that the face is broken down in steps. More specifically, each cycle may comprise the drilling of a single row of holes in the face and the charging of these holes with an explosive which is then initiated.

The present invention relates also to a machine for driving a tunnel in this way.

In U.S. Pat. No. 3,721,471 a method is described which comprises the opening up of a horizontal wedge cut in the middle of a vertical flat face, such as a tunnel face, and then stepwise horizontal stoping towards said cut. Since the cut is in the middle of the face the stoping is directed downwardly towards the cut in the steps that are carried out above the cut, but the stoping is directed upwardly towards the cut in the steps that are carried out below the cut. The mucking of the blasted rock will cause considerable dead time between the cycles.

The present invention provides for a more continuous working in cycles in which none of the cycles is affected by the rock blasted in a preceding cycle. Specifically the present invention makes it possible to work the face in a plurality of substantially identical cycles.

Summary of the Invention

To these ends there is provided a method for advancing an underground face of a geological formation in rounds comprising a plurality of cycles, each cycle comprising the drilling of a plurality of holes into the face and the applying of break-down-energy to the holes, characterized in that said face after each round is left with an inclined transition to the floor and, in a subsequent round, a cut is opened up in said transition towards the floor and the face is then stoped towards said cut stepwise in said cycles until the roof is reached.

There is also provided a machine for driving a tunnel comprising a support frame, a swingable frame mounted to said support frame to be swingable about a horizontal axis, power means to swing said swingable frame about said horizontal axis, a plurality of units mounted on said swingable frame, said units being capable of drilling a row of holes substantially simultaneously and being capable of applying break-down-energy to the holes just drilled.

BRIEF DESCRIPTION OF THE DRAWINGS

FIG. 4 is a section taken along line 4—4 in FIG. 3; and

FIGS. 5, 6 and 7 are longitudinal sections through tunnels to be advanced according to the invention and having other forms of the tunnel face.

DETAILED DESCRIPTION

Figure 1:
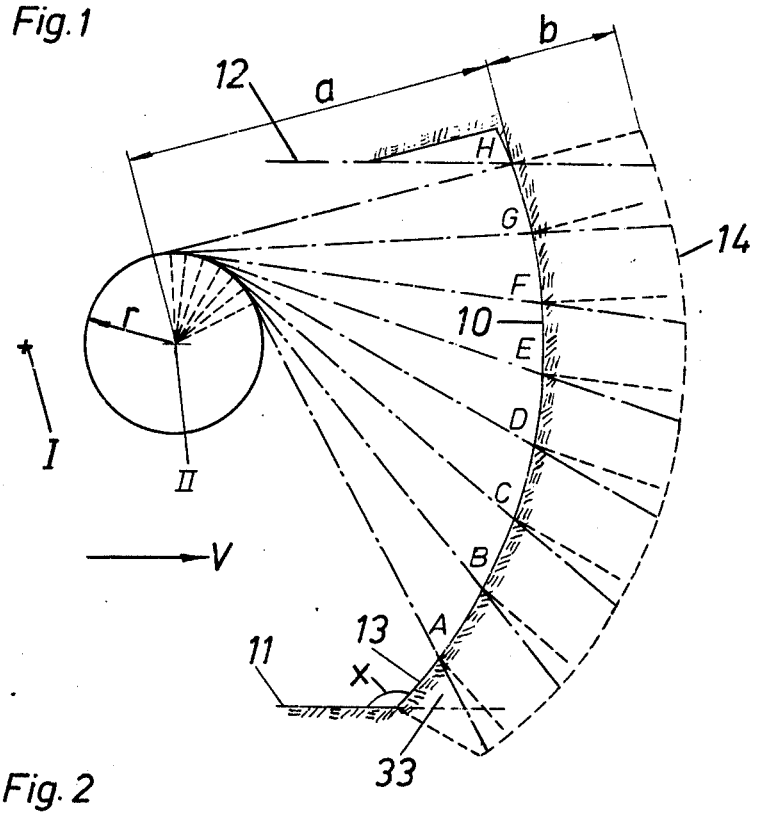
FIG. 1 is a longitudinal section through a tunnel to be advanced according to the invention.

FIG. 1 shows in a vertical section a horizontal tunnel which has a concave face 10, a floor 11 and a roof 12. The face 10 has the form of a part of a horizontal circular cylinder so that it forms an inclined transition 13 to the floor, forming an obtuse angle $x$ with the floor. The angle $x$ should preferably be greater than 120°.

Figure 2:
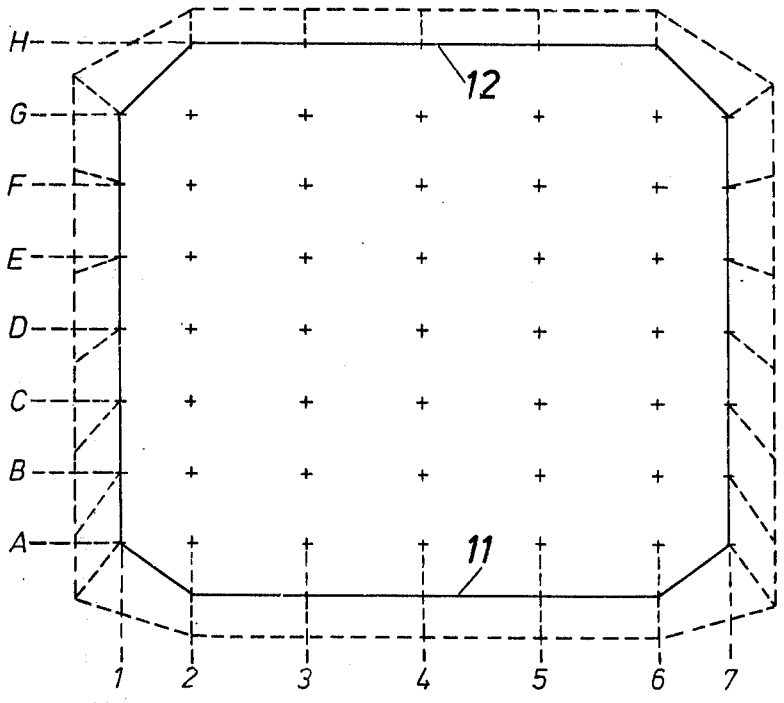
FIG. 2 is a view of the face of the tunnel shown in FIG. 1.

The tunnel face is shown in FIG. 2 and the positions of the holes that are to be drilled in a round for advancing the face 10 in the direction V (FIG. 1) to a new position 14 are indicated orthogonally by vertical indexes A-H and horizontal indexes 1–7. FIG. 1 is a section through the vertical row 3 of holes, and the axes of the holes are indicated in this figure. Preferably, a round should advance the face 10 a distance smaller than ⅓ of the distance between the roof and floor.

Figure 3:
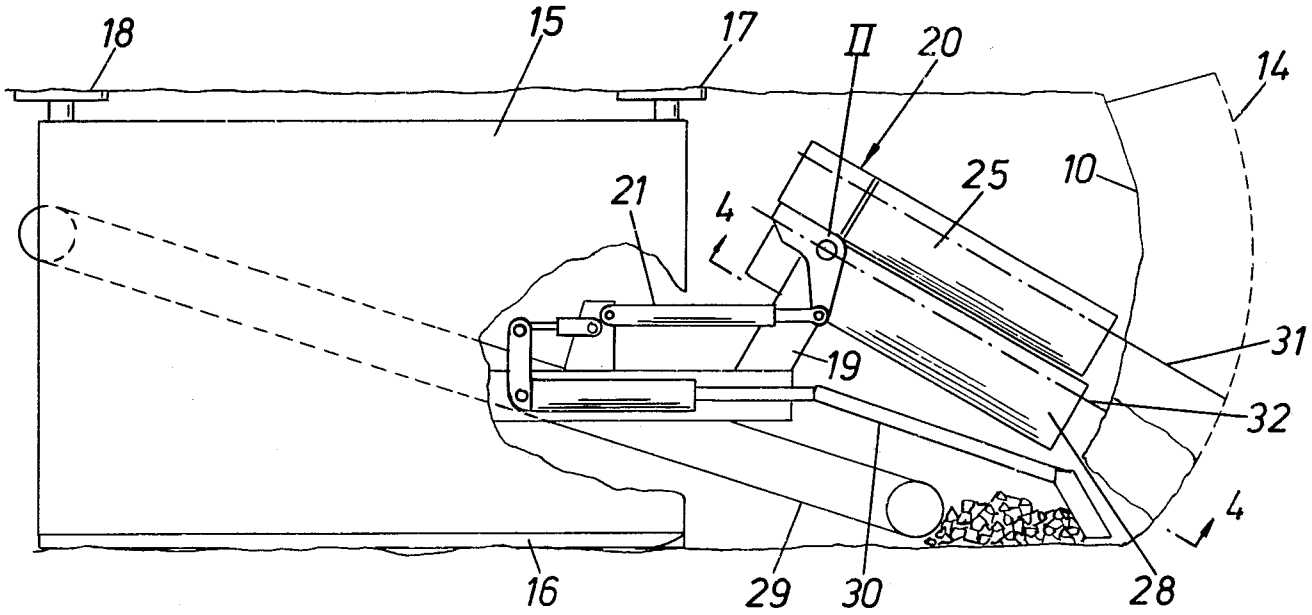
FIG. 3 is a longitudinal view of a machine according to the invention for advancing the tunnel shown in FIG. 1.

A machine is shown in FIGS. 3 and 4 for advancing the face 10 by drilling holes in the pattern indicated in FIGS. 1 and 2. The machine is only schematically shown and it has a main frame 15 supported on the tunnel floor by two runners 16. Two pairs of hydraulic rams 17,18 can be extended against the roof to brace the machine frame in the tunnel if necessary. The main frame 15 includes a bifurcated support 19 to which a swingable frame 20 is mounted to pivot about a horizontal axis II by the action of an hydraulic jack 21. Seven identical drill-and-blast units 22-28 are mounted on the swingable frame 20. The five units 23–27 are fixed on the frame 20 and they are parallel with each other in a common plane. Under these five drill-and-blast units there are two units 22, 28 that are mounted to pivot by the action of hydraulic cylinders about axes III and IV which are perpendicular to the respective axis of drilling. The axes III and IV are also perpendicular to the swing axis II of the swingable frame.

The interior of the drill-and-blast units are not shown since their details are not part of the invention. Be it sufficient to say that each of them incorporates a rock drill, mounted on a feed bar, for drilling a hole, and means to swing the drill out of line with the hole it has just been drilling and instead aligning an explosive delivery device and an explosive detonating device with the hole e.g. as disclosed in U.S. Pat. No. 3,721,471.

The machine has a conveyor 29 for the debris and a power scraper 30 to feed the conveyor.

In FIG. 3 is shown that the drill-and-blast unit 25 drills the hole D4 (see FIG. 2) while the drill-and-blast unit 28 drills the hole C1 (FIG. 2) and the scraper 30 feeds the conveyor 29. The drill steel of drill 25 is designated 31 and the drill steel of drill 28 is designated 32 and their axes of drilling is indicated by dash-and-dot lines.

A complete round for advancing the tunnel face 10 to its new position 14 will now be described with reference to FIGS. 1–4. At first, the swingable frame 20 is pivoted about axis II into a position in which the five drill-and-blast units 23–27 are positioned to drill the holes A2–A6. These five units are operated to drill the holes simultaneously, to charge the holes with an explosive and then to detonate the explosive. Preferably, the hole A4 is blasted first and then A3, A5, A2, A6 as delayed blasting in a conventional manner. This blasting opens up a cut 33 using the transition 13 of the tunnel face 10 to the floor 11 as a stope surface, and a new stope surface is developed extending through the blasted holes A2–A6. The swingable frame 20 is now swung to position the units 23–27 in position to drill and blast the holes B2-B6 simultaneously with the units 22 and 28 drilling and blasting the holes A1 and A7. Thus, the holes A1, B2-B6, and A7 form a single row of holes that are drilled and blasted substantially simultaneously, delayed blasting (interval blasting) being also now preferred. The subsequent cycle of drilling and blasting comprises the drilling and blasting of the holes B1, C2–C6, and B7, and a new stope surface is formed through these holes. The following cycles are identical with this one. In the last cycle of the round, the holes G1, H2-H6 and G7 are drilled and blasted. These holes are directed slightly upwardly and the other contour holes, i.e. the holes in the vertical rows 1 and 7 are slightly outwardly directed as can be seen in FIG. 2. A dashed line has been drawn in FIG. 2 through the bottom of the contour holes and the holes of the cut.

The reference numeral I in FIG. 1 indicates the position of axis II in the preceding round and the machine is moved forwards such a step between the rounds. The support 19 for the swingable frame 20 may alternatively be extendable relative to the main frame 15 in for example two such steps so that the main frame 15 need be moved only between every third round.

Since the swingable frame 20 pivots about the axis II and there is a distance between this axis and the drill axes of the drill-and-blast units, the axes of the holes that each machine drills in a round will be tangents to a circle that has the distance between the respective drill axis and the axis II as a radius. This circle with the radius $r$ is indicated in FIG. 1. The drill-and-blast units 23–27 are shown in a common plane. Instead, the distance between the drill-and-blast unit 25 and the axis II may be larger than the distances between the drill-and-blast units 24, 26 and the axis II which in turn may be larger than the distances between the drill-and-blast units 23, 27 and the axis II so that the horizontal rows of holes that are drilled and blasted in the cycles will be bow-formed.

Each drill-and-blast unit can be arranged to extend the drill rods to a fixed stop position during each drilling operation which means that the distance $a$ plus the distance $b$ in FIG. 1 will be constant for each hole although the depths $b$ of the holes will vary. Also all the holes can preferably be charged with like amounts of explosives. These facts simplify the operational control of the machine.

FIG. 5 shows a tunnel with a circular tunnel face like the one in FIGS. 1 and 2 but the hole axes intersect horizontal axis II. The direction of the first row of holes for opening up the cut will then not be as good as in FIG. 1, and an additional vertical row of holes K may be utilized to open up the cut. As in FIG. 1, the axis I is the center of circles of which the circular tunnel face 10 is part and the axis II is the center of circles of which the circular advanced tunnel face 14 is part.

FIG. 6 shows a tunnel in which the entire tunnel face is oblique. A vertical row of holes K is advantageous also here.

FIG. 7 shows a tunnel in which the main part of the tunnel face is vertical. The lowest part 35 of the tunnel face, however, is inclined.

Although the invention is described with reference to conventional drilling and blasting, the break-down-energy may be applied to the holes in any other way than by explosives, for example by wedging, and the illustrated drill-and-blast units can be replaced by any other units for drilling holes and applying break-down-energy to the holes. The method and the machine may also be modified in many other ways within the scope of the claims.

We claim:

1. A method for advancing a tunnel end face in rounds, each round comprising a plurality of cycles, each cycle comprising drilling a plurality of holes into the tunnel end face and then applying break-down-energy to the holes, the improvement comprising:

drilling said holes and applying said break-down-energy with a rig such that said tunnel end face after each round is left with an inclined transition to the tunnel floor and that said tunnel end face, after a complete round, is concave as seen in vertical planes which are substantially parallel with the direction of advancement, said tunnel end face, after said complete round, forming part of circles in vertical planes which are substantially parallel with the direction of advancement, said circles having their centers on a substantially horizontal straight line that is closer to the roof than to the floor of the tunnel; maintaining the rig at the face during both drilling of said holes and applying said break-down-energy; and, in a subsequent round, opening up a cut in said inclined transition towards the tunnel floor and then stoping the tunnel end face towards said cut stepwise in at least two of said cycles until the roof is reached, said cut and each said stoping steps extending over substantially the whole width of the tunnel end face.

2. A method according to claim 1 in which the holes of each cycle in a round are directed to diverge relative to the holes in the preceding cycle.

3. A method according to claim 2 in which the holes in the first cycle after the opening up of the cut are drilled forwardly-downwardly and the holes in the last cycle of a round are drilled forwardly-upwardly.

4. A method according to claim 1 in which the holes drilled in each cycle are charged with an explosive, and comprising detonating said charged explosive before the drilling of new holes in the subsequent cycle is started.

5. A method according to claim 1 comprising opening up the cut by drilling a row of substantially parallel holes.

6. A method according to claim 1 in which all the holes drilled in a round are shorter than ⅓ of the distance between roof and floor.

7. A machine for driving a tunnel face, comprising:

a support frame, a swingable frame mounted to said support frame to be swingable about a substantially horizontal axis, power means coupled to said swingable frame to swing said swingable frame about said horizontal axis, and a plurality of drilling and break-down-energy applying units mounted on said swingable frame, said units being located and mounted on said frame to substantially simultaneously drill a substantially transverse row of holes, which row extends over substantially the whole width of the tunnel face and for applying break-down-energy to the holes just drilled, a number of said units being fixedly and immovably mounted to said swingable frame and being oriented substantially parallel with each other, and, at both sides of said swingable frame, one of said units being pivotably mounted to said swingable frame to pivot about an axis transverse to a longitudinal axis of the unit itself and transverse to said horizontal axis about which the swingable frame is pivotable.

8. A machine according to claim 7 in which said pivotably mounted units are mounted to pivot in a plane below said fixedly mounted units.

9. A method for advancing a tunnel end face in rounds, each round comprising a plurality of cycles, each cycle comprising drilling a plurality of holes into the tunnel end face and then applying break-down-energy to the holes, the improvement comprising:

drilling said holes and applying said break-down-energy with a rig such that said tunnel end face after each round is left with an inclined transition to the tunnel floor and that said tunnel end face, after a complete round, is concave as seen in vertical planes which are substantially parallel with the direction of advancement, said tunnel end face, after said complete round, forming part of circles in vertical planes which are substantially parallel with the direction of advancement, said circles having their centers on a substantially horizontal straight line that is closer to the roof than to the floor of the tunnel; maintaining the rig at the face curing both drilling of said holes and applying said break-down-energy; and, in a subsequent round, opening up a cut in said inclined transition towards the tunnel floor and then stoping the tunnel end face towards said cut stepwise in a plurality of said cycles until the roof is reached, said cut extending over substantially the whole width of the tunnel end face and each said stoping step extending over the whole width of the tunnel end face.

10. A method according to claim 9 in which the holes of each cycle in a round are directed to diverge relative to the holes in the preceding cycle.

11. A method according to claim 9 in which, in the cycles of the stoping steps, a row of substantially parallel holes and, at each side, an obliquely outwardly directed side hole are drilled simultaneously.

12. A method according to claim 11 in which the holes are drilled in substantially the same pattern in all the cycles of a round except that said side holes are omitted in the cycle for opening up the cut.

13. A method according to claim 11 comprising opening up the cut by drilling a row of substantially parallel holes.

14. A method according to claim 9 comprising drilling a single row of holes in each of said cycles.

15. A method for advancing a tunnel face in rounds, each round comprising a plurality of cycles, each cycle comprising drilling a plurality of holes into the tunnel face and then applying break-down-energy to the holes, the improvement comprising: drilling said holes and applying said break-down-energy such that said tunnel face after each round is left with an inclined transition to the tunnel floor; and, in a subsequent round, opening up a cut in said inclined transition towards the tunnel floor and then stoping the tunnel face towards said cut stepwise in said cycles until the roof is reached such that, after a complete round, the tunnel face forms part of circles in vertical planes which are substantially parallel with the direction of advancement, said circles having their centers on a substantially horizontal straight line that is closer to the roof than to the floor.

16. A method according to claim 15 in which the holes of each cycle in a round are directed to diverge relative to the holes in the preceding cycle.

17. A method according to claim 15 comprising drilling a single row of holes in each of said cycles.

18. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-down-energy such that said tunnel face after each round is left with an inclined transition to the tunnel floor; and, in a subsequent round, opening up a cut in said inclined transition towards the tunnel floor and then stoping the tunnel face towards said cut stepwise in said cycles until the roof is reached, the holes of each cycle in a round being directed to diverge relative to the holes in the preceding cycle.

19. A method according to claim 18 in which, after a complete round, the entire tunnel face is concave as seen in vertical planes which are substantially parallel with the direction of advancement.

20. A method according to claim 18 in which, after a complete round, the tunnel face forms part of circles in vertical planes which are substantially parallel with the direction of advancement.

21. A method according to claim 20 in which said circles have their centers on a substantially horizontal straight line that is closer to the roof than to the floor.

22. A method according to claim 18 in which the holes in the first cycle after the opening up of the cut are drilled forwardly-downwardly and the holes in the last cycle of a round are drilled forwardly-upwardly.

23. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-downenergy such that said tunnel face after each round is left with an inclined transition to the tunnel floor; and, in a subsequent round, opening up a cut in said inclined transition towards the tunnel floor and then stoping the tunnel face towards said cut stepwise in said cycles until the roof is reached, at least the holes of each cycle subsequent to the first cycle after the cycle for opening up the cut being directed to diverge relative to the holes in the respective preceding cycle.

24. A method according to claim 23 in which after a complete round, the entire tunnel face is concave as seen in vertical planes which are substantially parallel with the direction of advancement.

25. A method according to claim 23 in which, after a complete round, the tunnel face forms part of circles in vertical planes which are substantially parallel with the direction of advancement.

26. A method according to claim 25 in which said circles have their centers on a substantially horizontal straight line that is closer to the roof than to the floor.

27. A method according to claim 23 in which the holes in the first cycle after the opening up of the cut are drilled forwardly-downwardly and the holes in the last cycle of a round are drilled forwardly-upwardly.

28. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-downenergy such that said tunnel face after each round is left with an inclined transition to the tunnel floor; and, in a subsequent round, opening up a cut in said inclined transition towards the tunnel floor and then stoping the tunnel face towards said cut stepwise in said cycles until the roof is reached, said stoping step comprising substantially simultaneously drilling a row of substantially parallel holes and, at each side of said plurality of substantially parallel holes, an obliquely outwardly directed side hole.

29. A method according to claim 28 in which the holes are drilled in substantially the same pattern in all the cycles of a round except that said side holes are omitted in the cycle for opening up the cut.

30. A method according to claim 28 comprising opening up the cut by drilling a row of substantially parallel holes.

31. A method according to claim 28 in which, after a complete round, the entire tunnel face is concave as seen in vertical planes which are substantially parallel with the direction of advancement.

32. A method according to claim 28 in which, after a complete round, the tunnel face forms part of circles in vertical planes which are substantially parallel with the direction of advancement.

33. A method according to claim 32 in which said circles have their centers on a substantially horizontal straight line that is closer to the roof than to the floor.

34. A method according to claim 28 in which the holes of each cycle in a round are directed to diverge relative to the holes in the preceding cycle.

35. A method according to claim 34 in which the holes in the first cycle after the opening up of the cut are drilled forwardly-downwardly and the holes in the last cycle of a round are drilled forwardly-upwardly.

36. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-downenergy such that said tunnel face after each round is left with an inclined transition to the tunnel floor; and, in a subsequent round, opening up a cut in said inclined transition towards the tunnel floor and then stopping the tunnel face towards said cut stepwise in at least two of said cycles until the roof is reached, said cut and each said stoping steps extending over substantially the whole width of the tunnel, the holes of each cycle in a round being directed to diverge relative to the holes in the preceding cycle.

37. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-downenergy such that said tunnel face after each round is left with an inclined transition to the tunnel floor; and, in a subsequent round, opening up a cut in said inclined transition towards the tunnel floor and then stoping the tunnel face towards said cut stepwise in at least two of said cycles until the roof is reached, said cut and each said stoping steps extending over substantially the whole width of the tunnel; and wherein in the cycles of the stoping steps, a row of substantially parallel holes and, at each side, an obliquely outwardly directed side hole are drilled simultaneously.

38. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-downenergy such that said tunnel face after each round is left with an inclined transition to the tunnel floor and that said tunnel face after each round forms part of circles in vertical planes which are substantially parallel with the direction of advancement, said circles having their centers on a substantially horizontal straight line that is closer to the roof than to the floor of the tunnel; and, in a subsequent round, opening up a cut in said inclined transition towards the tunnel floor and then stoping the tunnel face towards said cut stepwise in at least two of said cycles until the roof is reached, said cut extending over substantially the whole width of the tunnel and each said stoping step extending over the whole width of the tunnel.

39. A method for advancing a tunnel face in rounds, each round comprising a plurality of cycles, each cycle comprising drilling a plurality of holes into the tunnel face and then applying break-down-energy to the holes, the improvement comprising:

drilling said holes and applying said break-downenergy such that said tunnel face after each round is left with an inclined transition to the tunnel floor; and, in a subsequent round, opening up a cut in said inclined transition towards the tunnel floor and then stoping the tunnel face towards said cut stepwise in at least two of said cycles until the roof is reached, said cut extending over substantially the whole width of the tunnel and each said stoping step extending over the whole width of the tunnel, the holes of each cycle in a round being directed to diverge relative to the holes in the preceding cycle.

40. A method for advancing a tunnel face in rounds each round comprising a plurality of cycle, each cycle comprising drilling a plurality of holes into the tunnel face and then applying break-down-energy to the holes, the improvement comprising:

drilling said holes and applying said break-downenergy such that said tunnel face after each round is left with ain inclined transition to the tunnel floor; and, in a subsequent round, opening up a cut in said inclined transition towards the tunnel floor and then stoping the tunnel face towards said cut stepwise in at least two of said cycles until the roof is reached, said cut extending over substantially the whole width of the tunnel and each said stoping step extending over the whole width of the tunnel; and wherein in the cycles of the stoping steps, a row of substantially parallel holes and, at each side, an obliquely outwardly directed side hole are drilled simultaneously.

41. A method for advancing a tunnel end face in rounds, each round comprising a plurality of cycles, each cycle comprising drilling a plurality of holes into the tunnel end face and then applying break-down-energy to the holes, the improvement comprising:

drilling said holes and applying said break-downenergy with a rig such that said tunnel end face after each round is left with an inclined transition to the tunnel floor and that said tunnel end face, after a complete round, is concave as seen in vertical planes which are substantially parallel with the direction of advancement, the holes of each cycle in a round being directed to diverge relative to the holes in the preceding cycle; maintaining the rig at the face during both drilling of said holes and applying said break-down-energy; and, in a subsequent round, opening up a cut in said inclined transition towards the tunnel floor and then stoping the tunnel end face towards said cut stepwise in at least two of said cycles until the roof is reached, said cut and each said stoping steps extending over substantially the whole width of the tunnel end face.

42. A method according to claim 41 in which the holes in the first cycle after the opening up of the cut are drilled forwardly-downwardly and the holes in the last cycle of a round are drilled forwardly-upwardly.

43. A method according to claim 41 in which the axes of corresponding holes drilled in subsequent cycles form tangents to a circle.

44. A method according to claim 42 in which the axes of corresponding holes drilled in subsequent cycles form tangents to a circle.

45. A method for advancing a tunnel end face in rounds, each round comprising a plurality of cycles, each cycle comprising drilling a plurality of holes into the tunnel end face and then applying break-down-energy to the holes, the improvement comprising:

drilling said holes and applying said break-downenergy with a rig such that said tunnel end face after each round is left with an inclined transition to the tunnel floor and that said tunnel end face, after a complete round, is concave as seen in vertical planes which are substantially parallel with the direction of advancement; maintaining the rig at the face during both drilling of said holes and applying said break-downenergy; and, in a subsequent round, opening up a cut in said inclined transition towards the tunnel floor and then stoping the tunnel end face towards said cut stepwise in at least two of said cycles until the roof is reached, said cut and each said stoping steps extending over substantially the whole width of the tunnel end face; and wherein in the cycles of the stoping steps, a row of substantially parallel holes and, at each side, an obliquely outwardly directed side hole are drilled simultaneously.

46. A method according to claim 45 in which said side holes are drilled in a plane below said substantially parallel holes.

47. A method according to claim 45 in which the holes are drilled in substantially the same pattern in all the cycles of a round except that said side holes are omitted in the cycle for opening up the cut.

48. A method according to claim 46 in which the holes are drilled in substantially the same pattern in all the cycles of a round except that said side holes are omitted in the cycle for opening up the cut.

49. A method for advancing a tunnel end face in rounds, each round comprising a plurality of cycles, each cycle compriing drilling a plurality of holes into the tunnel end face and then applying break-down-energy to the holes, the improvement comprising:

drilling said holes and applying said break-downenergy with a rig such that said tunnel end face after each round is left with an inclined transition to the tunnel floor and that said tunnel end face, after a complete round, is concave as seen in vertical planes which are substantially parallel with the direction of advancement, the holes of each cycle in a round being directed to diverge relative to the holes in the preceding cycle; maintaining the rig at the face during both drilling of said holes and applying said break-down-energy; and, in a subsequent round, opening up a cut in said inclined transition towards the tunnel floor and then stoping the tunnel end face towards said cut stepwise in a plurality of said cycles until the roof is reached, said cut extending over substantially the whole width of the tunnel end face and each said stoping step extending over the whole width of the tunnel end face.

50. A method for advancing a tunnel end face in rounds, each round comprising a plurality of cycles, each cycle comprising drilling a plurality of holes into the tunnel end face and then applying break-down-energy to the holes, the improvement comprising:

drilling said holes and applying said break-downenergy with a rig such that said tunnel end face after each round is left with an inclined transition to the tunnel floor and that said tunnel end face, after a complete round, is concave as seen in vertical planes which are substantially parallel with the direction of advancement; maintaining the rig at the face during both drilling of said holes and applying said break-down-energy; and, in a subsequent round, opening up a cut in said inclined transition towards the tunnel floor and then stoping the tunnel end face towards said cut stepwise in a plurality of said cycles until the roof is reached, said cut extending over substantially the whole width of the tunnel end face and each said stoping step extending over the whole width of the tunnel end face; and wherein in the cycles of the stoping steps, a row of substantially parallel holes and, at each side, an obliquely outwardly directd side hole are drilled simultaneously.

51. A method according to claim 50 in which said side holes are drilled in a plane below said substantially parallel holes.

52. A method according to claim 50 in which the holes are drilled in substantially the same pattern in all the cycles of a round except that said side holes are omitted in the cycle for opening up the cut.

* * * * *